US010918253B2

(12) United States Patent
Li et al.

(10) Patent No.: US 10,918,253 B2
(45) Date of Patent: Feb. 16, 2021

(54) HANDHELD SWEEPING AND MOPPING STRUCTURE

(71) Applicant: Hubei Dstech Co. Ltd, Ezhou (CN)

(72) Inventors: Xiaolin Li, Guangdong (CN); Ni Peng, Guangzhou (CN); Kaiwen Lin, Guangdong (CN)

(73) Assignee: HUBEI DSTECH CO. LTD, Ezhou (CN)

( * ) Notice: Subject to any disclaimer, the term of this patent is extended or adjusted under 35 U.S.C. 154(b) by 106 days.

(21) Appl. No.: 16/424,512

(22) Filed: May 29, 2019

(65) Prior Publication Data

US 2019/0274508 A1 Sep. 12, 2019

(30) Foreign Application Priority Data

Apr. 30, 2019 (CN) ..... 2019 1 0363259

(51) Int. Cl.

| | |
|---|---|
| ***A47L 11/292*** | (2006.01) |
| ***A47L 11/282*** | (2006.01) |
| ***A47L 11/03*** | (2006.01) |
| ***A47L 11/20*** | (2006.01) |
| ***A47L 11/40*** | (2006.01) |
| ***A47L 11/24*** | (2006.01) |
| ***A47L 11/10*** | (2006.01) |
| ***A47L 11/14*** | (2006.01) |

(52) U.S. Cl.

CPC ..... *A47L 11/292* (2013.01); *A47L 11/03* (2013.01); *A47L 11/10* (2013.01); *A47L 11/145* (2013.01); *A47L 11/20* (2013.01); *A47L 11/24* (2013.01); *A47L 11/282* (2013.01); *A47L 11/408* (2013.01); *A47L 11/4013* (2013.01); *A47L 11/4075* (2013.01); *A47L 11/4083* (2013.01)

(58) Field of Classification Search

CPC ..... A47L 11/03; A47L 11/085; A47L 11/145; A47L 11/26; A47L 11/28; A47L 11/282; A47L 11/29; A47L 11/292; A47L 11/30; A47L 11/302; A47L 11/4013; A47L 11/4016; A47L 11/4025; A47L 11/408; A47L 11/4088

USPC ..... 15/320, 52, 98, 103.5

See application file for complete search history.

(56) References Cited

U.S. PATENT DOCUMENTS 2,642,601 A * 6/1953 Saffioti ..... A47L 11/4088 15/98

4,173,054 A * 11/1979 Ando ..... A47L 11/292 15/98

(Continued)

FOREIGN PATENT DOCUMENTS

DE 102016111808 * 12/2017

WO 01/037716 * 5/2001

*Primary Examiner* — Mark Spisich

(57) ABSTRACT

The present invention provides a handheld sweeping and mopping structure, comprising a handle and a body shell, wherein a sweeping and mopping module, a water tank module, a driving module, a garbage collection module, a control module and a power supply module are provided inside the body shell. The handheld sweeping and mopping structure of the present invention can sweep the floor and also mop the floor, has higher efficiency and better effect than the conventional sweeping and mopping mode; and meanwhile, a disposable garbage box which is convenient to replace is used, and it is unnecessary to clean the garbage box repeatedly.

8 Claims, 5 Drawing Sheets

(56) References Cited

U.S. PATENT DOCUMENTS

| | | | | | |
|---|---|---|---|---|---|
| 4,875,246 | A * | 10/1989 | MacGregor | A47L 11/185 15/98 |
| 5,657,503 | A * | 8/1997 | Caruso | A47L 11/03 15/97.1 |
| 5,657,504 | A * | 8/1997 | Khoury | A47L 11/03 15/103.5 |
| 2018/0206685 | A1* | 7/2018 | Li | A47L 11/282 |
| 2019/0246859 | A1* | 8/2019 | Li | A47L 11/4088 |
| 2019/0246860 | A1* | 8/2019 | Li | A47L 11/302 |

* cited by examiner

HANDHELD SWEEPING AND MOPPING STRUCTURE

BACKGROUND OF THE INVENTION

The present invention relates to the technical field of sweepers, and in particular to a handheld sweeping and mopping structure.

Cleaning devices can be classed into large cleaning devices and small cleaning devices. General household or office cleaning devices include brooms, mops, and later-developed vacuum cleaners, electric brooms, steam mops and the like. Although conventional brooms or mops are cheap, it is relatively time-consuming for cleaning. Meanwhile, the conventional mops further have the disadvantage that the floor does not become dry for a long time, and the mop cleaning is also troublesome. As a result, more and more people choose to purchase electric cleaning products such as electric brooms and steam mops. At present, some electric brooms and electric mops on the market just fulfill their functions separately and are not cooperated well, so they are inconvenient to use and have a single function.

Common hand brooms and mops are operated manually, and it is labor-consuming for cleaning the floor. Some electric brooms and electric mops just fulfill their functions separately and are not cooperated well, so it is inconvenient to use.

BRIEF SUMMARY OF THE INVENTION

The present invention provides a handheld sweeping and mopping structure, which solves the problem that the existing mop devices are inconvenient to use by technically improving existing sweeping and mopping devices.

To solve the above technical problem, the present invention specifically employs the following solutions.

A handheld sweeping and mopping structure is provided, including a handle and a body shell, wherein a lower part of the handle is connected to the body shell via a universal joint, and a sweeping and mopping module, a water tank module, a driving module, a garbage collection module, a control module and a power supply module are provided inside the body shell;

the sweeping and mopping module includes a sponge roller and a water sink rod, wherein the sponge roller is driven to rotate by the driving module fixed inside the body shell, the water sink rod is provided inside the body shell, the water sink rod is tightly attached to the sponge roller, and a cleaning sink is formed on a contact surface of the water sink rod with the sponge roller;

the water tank module includes a clean water tank, a waste water tank, a water supply means, a water pumping means and an intermediate connector, wherein the clean water tank and the waste water tank are mounted at two ends of the intermediate connector, the clean water tank is connected to the water supply means arranged outside the intermediate connector, the water supply means is used for pumping clean water in the clean water tank to the cleaning sink, the waste water tank is connected to the water pumping means arranged outside the intermediate connector, and the water pumping means is used for pumping waste water in the cleaning sink to the waste water tank;

the driving module includes a driving motor, an output end of which is connected to the sponge roller;

the garbage collection module includes a garbage box and a garbage box cover, wherein an accommodation port for allowing the garbage box to be inserted therein is formed on a side face of the body shell, the garbage box is provided behind the sponge roller and a shovel strip is provided below an opening of the garbage box directly facing the sponge roller, the garbage box cover is further mounted above the garbage box, a row of hairbrushes are further provided on the garbage box cover, the hairbrushes are fitted with the sponge roller and used for cleaning the sponge roller, and a disposable garbage box is further provided in the garbage box;

the control module includes a PCB control board, wherein the PCB control board is mounted within the body shell and is connected to the driving module and the water tank module, and the PCB control board is used for controlling the turn-on or turn-off of the driving module and the water tank module; and the power supply module includes a battery used for supplying power to the driving module and the control module.

Compared with the prior art, the present invention has the following beneficial effects:

1) In the present invention, by driving the sponge roller to rotate by the driving motor, the garbage on the floor can be swept into the garbage box arranged behind the sponge roller. After the water supply means of the water tank module is activated, water in the clean water tank will be released to the cleaning sink to clean the sponge roller. The cleaned sponge roller rubs with the floor to complete the mopping operation, so that the floor is scrubbed in real time by the clean roller. The handheld sweeping and mopping structure of the present invention can sweep the floor and also mop the floor, is diversified in function and convenient to use, and has higher efficiency and better effect than the conventional sweeping and mopping mode.

2) In the present invention, a row of hairbrushes is provided on the garbage box cover, and the hairbrushes are fitted with the sponge roller and are cleaned by the self-rotation of the sponge roller, avoiding the problem of complicated cleaning at multiple positions.

3) In the present invention, by providing a replaceable disposable garbage box in the garbage box, the disposable garbage box can be replaced by pulling out the disposable garbage box from the sealing cover, and the consumption of time and labor caused by repeatedly cleaning the garbage box is avoided. Meanwhile, the disposable garbage box made from waterproof paper is low in cost and high in practicability.

4) In the present invention, an anti-backflow means is provided at a waste water inlet. After the water pumping means is activated, a negative pressure is generated in the waste water tank, thus the waste water pushes a water blocking sheet to expand into the waste water tank and enters. When the waste water tank is full, the waste water pushes the water blocking sheet to block the waste water inlet, so the waste water does not flow out.

Reference numbers: 1: handle; 2: body shell; 3: universal joint; 4: sweeping and mopping module; 5: water tank module; 6: driving module; 7: garbage collection module; 8: control module; 9: power supply module; 11: control switch; 21: upper cover; 22: lower cover; 211: upper turnover cover; 221: lower turnover cover; 23: front baffle; 24: buffer spring; 25: auxiliary roller wheel; 41: sponge roller; 42: water sink rod; 43: cleaning sink; 51: intermediate connector; 52: clean water tank; 53: waste water tank; 54: water supply means; 55: water pumping means; 61: driving motor; 71: garbage box; 72: disposable garbage box; 73: garbage box cover; 74: hairbrush; 75: shovel strip; 711: accommodation port; 81: PCB control board; 91: battery; 541: water-pump inlet pipe; 542: water pump; 543: clean water outlet pipe; 551: air-pump inlet pipe; 552: air pump; 553: air-pump outlet pipe; 554: waste water outlet pipe; 531: waste water inlet; 532: anti-backflow means; 521: support; and, 5322: water blocking sheet.

DETAILED DESCRIPTION OF THE INVENTION

The specific contents of the present invention will be described below in detail by embodiments with reference to the accompanying drawings.

Figure 1:
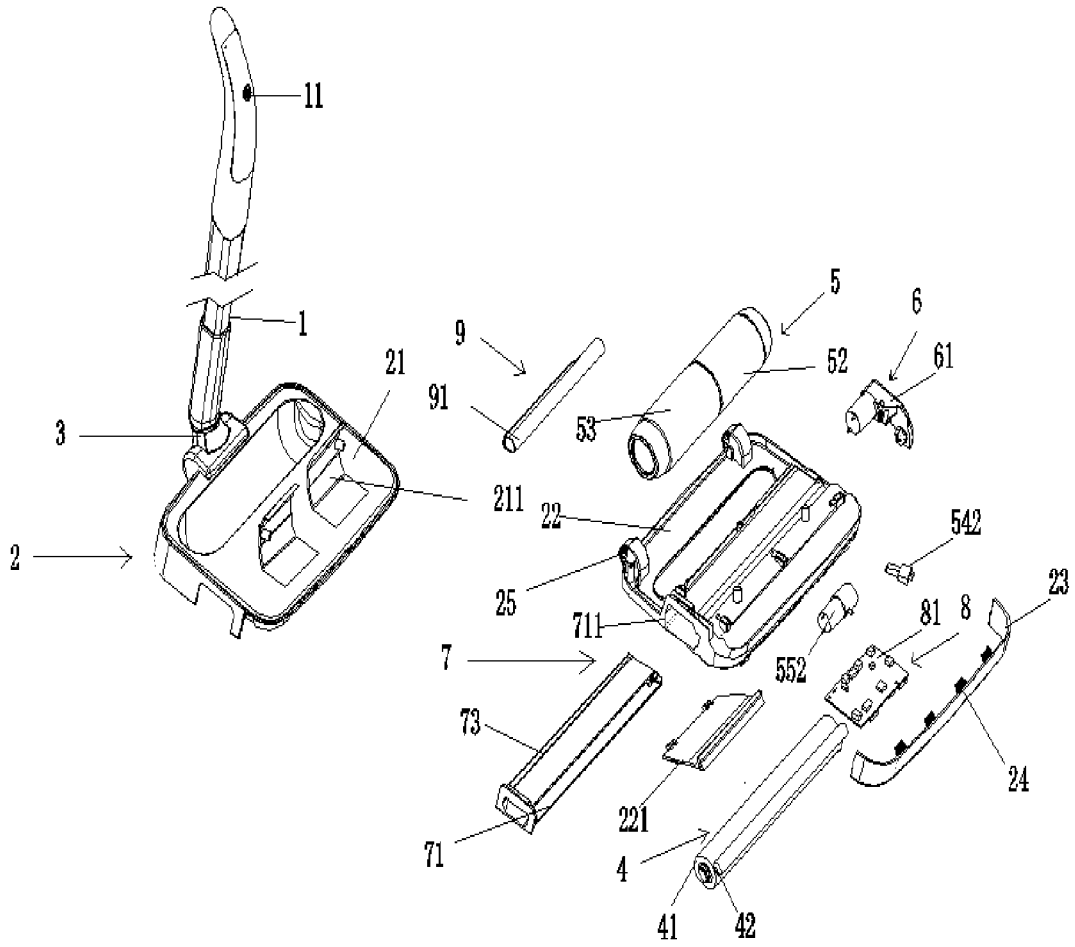
FIG. 1 is an exploded view of the present invention.
Figure 2:
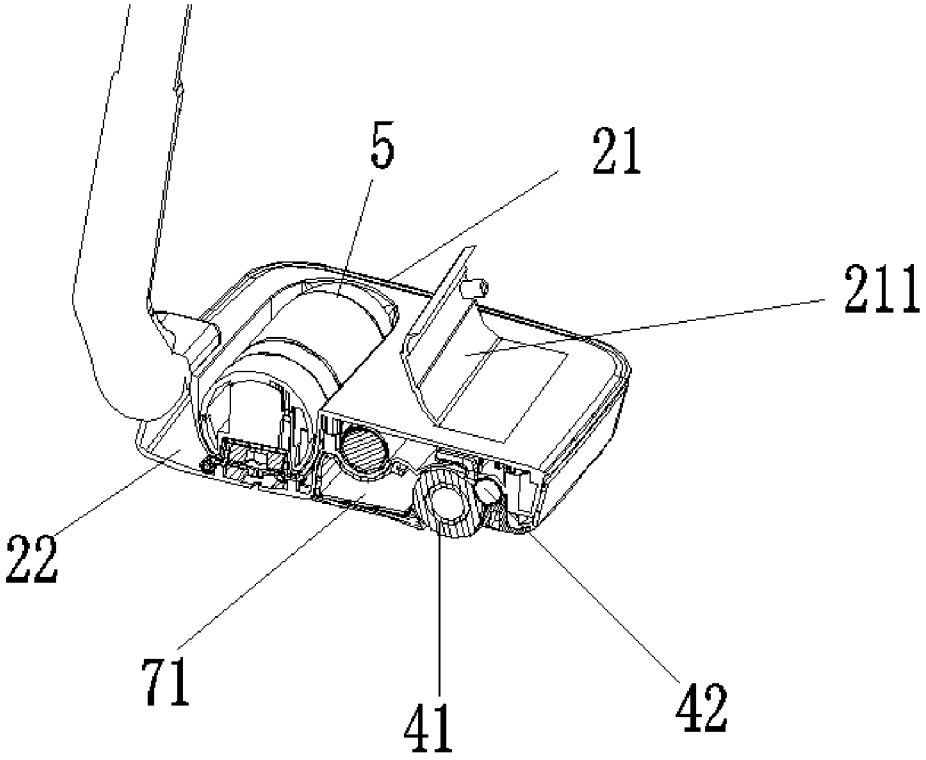
FIG. 2 is a schematic view of installation of the present invention.
Figure 3:
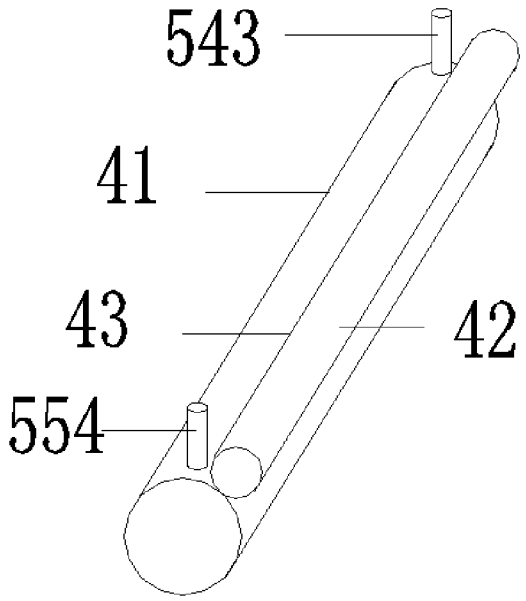
FIG. 3 is a schematic view of a cleaning sink according the present invention.
Figure 4:
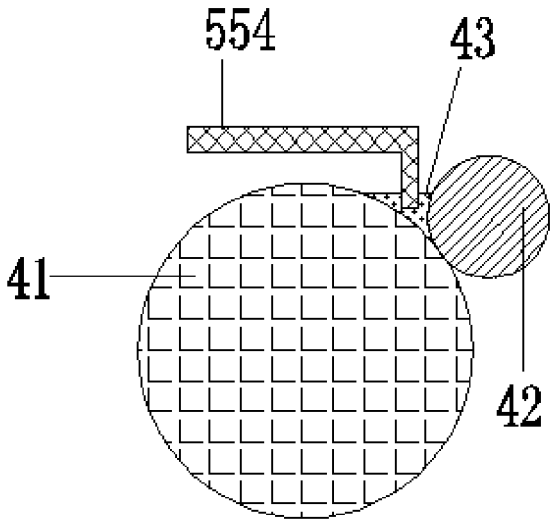
FIG. 4 is a sectional view of a sponge roller and a water sink rod.
Figure 5:
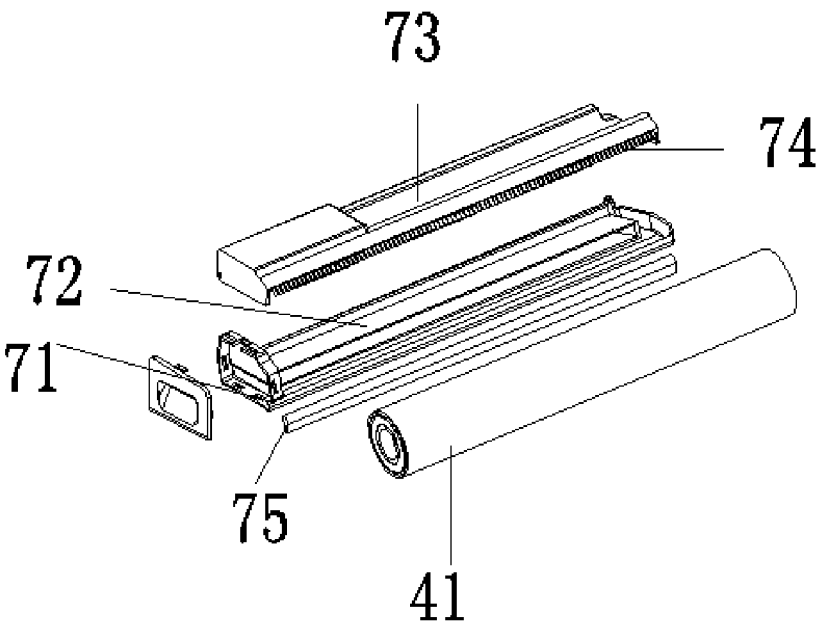
FIG. 5 is a schematic structural view of a garbage box according to the present invention.
Figure 6:
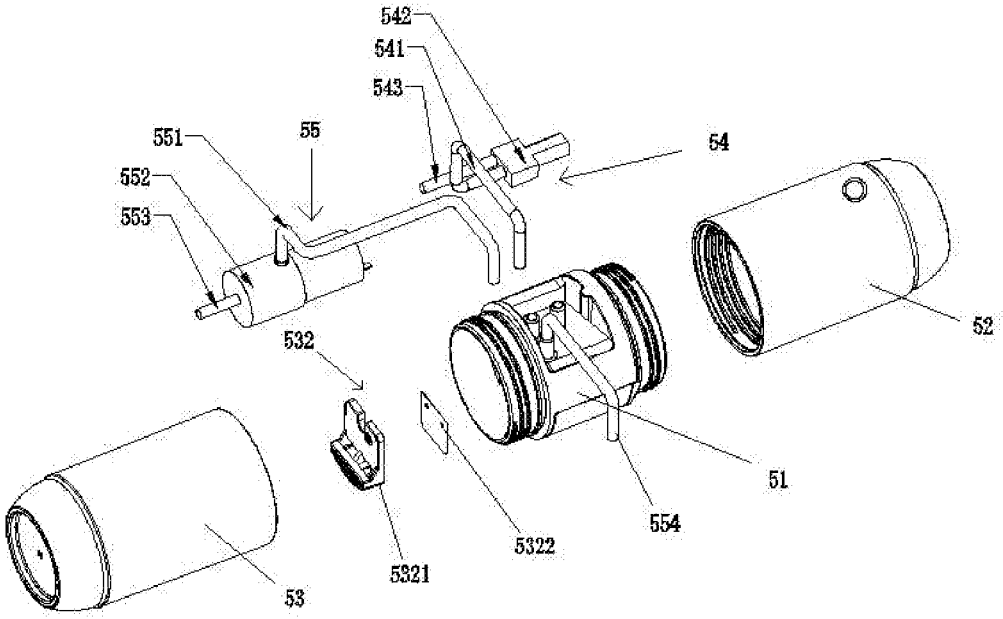
FIG. 6 is a schematic view of a water tank according to the present invention.
Figure 7:
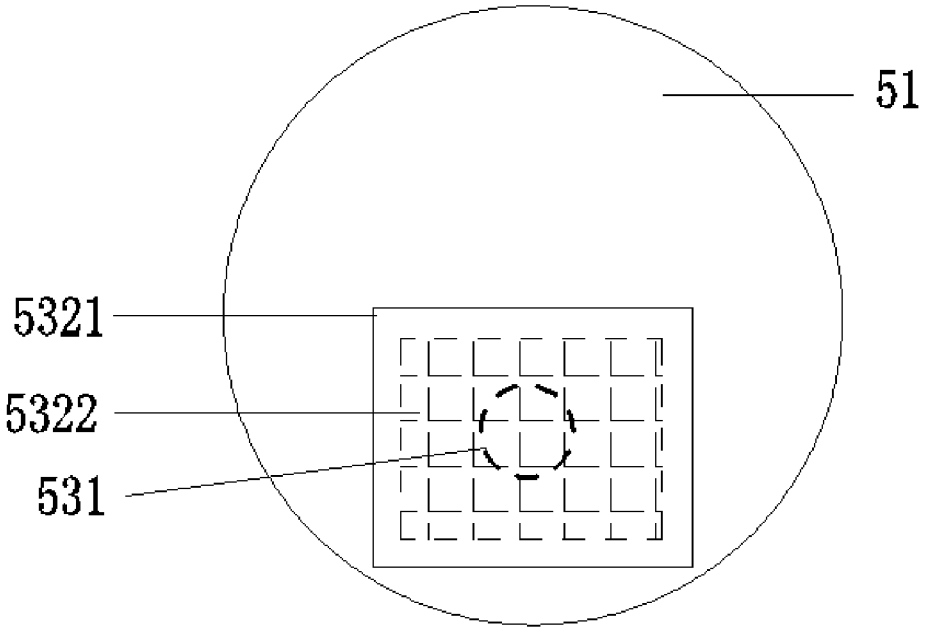
FIG. 7 is a schematic view of an anti-backflow means according to the present invention.

As shown in FIGS. 1-3, this embodiment provides a handheld sweeping and mopping structure, including a handle 1 and a body shell 2. A lower part of the handle 1 is connected to the body shell 2 via a universal joint 3. A sweeping and mopping module 4, a water tank module 5, a driving module 6, a garbage collection module 7, a control module 8 and a power supply module 9 are provided inside the body shell 2.

The sweeping and mopping module 4 includes a sponge roller 41 and a water sink rod 42. The sponge roller 41 is driven to rotate by the driving module 6 fixed inside the body shell 2. The water sink rod 42 is further provided inside the body shell 2. The water sink rod 42 is tightly attached to the sponge roller 41, and a cleaning sink 43 is formed on a contact surface of the water sink rod 42 with the sponge roller 41.

The water tank module 5 includes a clean water tank 52, a waste water tank 53, a water supply means 54, a water pumping means 55 and an intermediate connector 51. The clean water tank 52 and the waste water tank 53 are mounted at two ends of the intermediate connector 51. The clean water tank 52 is connected to the water supply means 54 arranged outside the intermediate connector 52. The water supply means 54 is used for pumping clean water in the clean water tank 52 to the cleaning sink 43. The waste water tank 53 is connected to the water pumping means 55 arranged outside the intermediate connector 51, and the water pumping means 55 is used for pumping waste water in the cleaning sink 43 to the waste water tank 53.

The driving module 6 includes a driving motor 61, an output end of which is connected to the sponge roller 41.

The garbage collection module 7 includes a garbage box 71 and a garbage box cover 73. An accommodation port 711 for allowing the garbage box 71 to be inserted therein is formed on a side face of the body shell 2. The garbage box 71 is provided behind the sponge roller 41 and a shovel strip 75 is provided below an opening of the garbage box 71 directly facing the sponge roller 41. The garbage box cover 73 is further mounted above the garbage box 71. A row of hairbrushes 74 is further provided on the garbage box cover 73. The hairbrushes 74 are fitted with the sponge roller 41 and used for cleaning the sponge roller 41. A disposable garbage box 72 is further provided in the garbage box 71. During the rotation of the sponge roller 41, the hairbrushes 74 can clean the surface of the sponge roller 41.

The control module 8 includes a PCB control board 81. The PCB control board 81 is mounted within the body shell 2 and is connected to the driving module 6 and the water tank module 5. The PCB control board 81 is used for controlling the turn-on or turn-off of the driving module 6 and the water tank module 5.

The power supply module 9 includes a battery 91 used for supplying power to the driving module 6 and the control module 8.

In order to realize that the water supply means 54 can quickly pump out clean water in the clean water tank 52, the water supply means 54 includes a water-pump inlet pipe 541, a water pump 542 and a clean water outlet pipe 543. The water-pump inlet pipe 541 is communicated with the clean water tank 52. The water pump 542 is disposed between the clean water outlet pipe 543 and the water-pump inlet pipe 541. The clean water outlet pipe 543 is provided at one end of the cleaning sink 43. By activating the water pump 542, water in the clean water tank 52 is pumped into the clean water outlet pipe 543 and then flows into the cleaning sink 43 until wetting the sponge roller 41.

In order to realize that the water pumping means 55 can pump waste water in the cleaning sink 43 to the waste water tank 53, the water pumping means 55 includes an air-pump inlet pipe 551, an air pump 552, an air-pump outlet pipe 553 and a waste water inlet pipe 554. The air-pump inlet pipe 551 is communicated with the waste water tank 53. The air pump 552 is disposed between the air-pump inlet pipe 551 and the air-pump outlet pipe 553. The waste water tank 53 is further connected to the waste water inlet pipe 554, and the waste water inlet pipe 554 is provided at the other end of the cleaning sink 43 facing away from the clean water outlet pipe 543. After the air pump 552 is activated, air in the waste water tank 53 will be pumped out to generate a negative pressure in the waste water tank 53, and waste water in the waste water inlet pipe 554 will enter the waste water tank 53 under the air pressure.

In order to prevent waste water in the waste water tank 53 from flowing back from the waste water inlet pipe 554, a waste water inlet 531 is formed at a junction of the waste water inlet pipe 554 with the waste water tank 54, and an anti-backflow means 532 is further provided within the waste water tank 53. The anti-backflow means 532 includes a support 5321 and a water blocking sheet 5322. The water blocking sheet 5322 is a bendable light-weight elastic sheet. The support 5321 is used for fixing the water blocking sheet 5322 at the waste water inlet 531. A clearance is reserved between the water blocking sheet 5322 and the waste water inlet 531, so that water in the waste water inlet pipe 554 can enter the waste water tank 53 after the water pumping means 55 is activated, and the water blocking sheet 5322 can cover the waste water inlet 531 after the water pumping means 55 is deactivated. After the water pumping means 55 is activated, a negative pressure is generated in the waste water tank 53, thus the waste water pushes the water blocking sheet 5322 to expand into the waste water tank 53 and enters. When the waste water tank is full, the water pressure caused by waste water pushes the water blocking sheet 5322 to block the waste water inlet 531, so that waste water does not flow out.

In order to make the disposable garbage box 72 more practical, the disposable garbage box 72 is made from waterproof paper. The use of the waterproof paper is low in cost and prevents waste water from leaking into the machine.

In order to conveniently clean the residual garbage in the cleaning sink 43 and take out the sponge roller 41 for cleaning, the body shell 2 includes an upper cover 21 and a lower cover 22. An upper turnover cover 211 capable of being opened or closed is provided on a surface of the upper cover 21. The upper turnover cover 211 is located directly above the cleaning sink 43. A lower turnover cover 221 capable of being opened or closed is further provided on the lower cover 22 of the body shell 2. The lower turnover cover 221 is located directly below the sponge roller 41, and the sponge roller 41 can be taken out from the lower turnover cover after the lower turnover cover 211 is opened. When the residual garbage in the cleaning sink needs to be cleaned, it is only necessary to open the upper turnover cover 211 and wash the cleaning sink. When the sponge roller needs to be cleaned, the sponge roller 41 can be taken out for cleaning by opening the lower turnover cover 221.

In order to avoid causing damage to the device when the body shell 2 collides with the outside, a front baffle 23 is further provided outside the body shell 2 and is connected to the body shell 2 through a number of buffer springs 24. The buffer springs 24 reduce an impact force generated when impact occurs, thus preventing the device from being damaged due to the impact.

In order to facilitate controlling of the turn-on or turn-off of the device during hand-holding, a control switch 11 connected to the PCB control board 81 is provided on the handle 1.

In order to make pushing and pulling the device more labor-saving during hand-holding and enable the device to have better motion effect, auxiliary roller wheels 25 capable of rotating relative to the body shell 2 are provided around a lower surface of the body shell 2.

By driving the sponge roller 41 to rotate by the driving motor 61, the garbage on the floor can be swept into the disposable garbage box 72 arranged behind the sponge roller 41. After the water supply means 54 of the water tank module 5 is activated, water in the clean water tank 52 will be released to the cleaning sink 43 to clean the sponge roller 41. The cleaned sponge roller 41 rubs with the floor to complete the mopping operation.

Finally, it is to be noted that the foregoing embodiments are merely for illustrating rather than limiting the technical solutions of the present invention. Although the present invention has been described in detail by the preferred embodiments, it should be understood by a person of ordinary skill in the art that modifications or equivalent replacements can be made to the technical solutions of the present invention without departing from the gist and scope of the technical solutions of the present invention, and those modifications or equivalent replacements shall fall into the scope of the appended claims of the present invention.

What is claimed is:

1. A handheld sweeping and mopping structure, comprising a handle and a body shell, wherein a lower part of the handle is connected to the body shell via a universal joint, and a sweeping and mopping module, a water tank module, a driving module, a garbage collection module, a control module and a power supply module are provided inside the body shell;

the sweeping and mopping module comprises a sponge roller and a water sink rod, wherein the sponge roller is driven to rotate by the driving module fixed inside the body shell, the water sink rod is further provided inside the body shell, the water sink rod is tightly attached to the sponge roller, and a cleaning sink is formed on a contact surface of the water sink rod with the sponge roller;

the water tank module comprises a clean water tank, a waste water tank, a water supply means, a water pumping means and an intermediate connector, wherein the clean water tank and the waste water tank are mounted at two ends of the intermediate connector, the clean water tank is connected to the water supply means arranged outside the intermediate connector, the water supply means is used for pumping clean water in the clean water tank to the cleaning sink, the waste water tank is connected to the water pumping means arranged outside the intermediate connector, and the water pumping means is used for pumping waste water in the cleaning sink to the waste water tank;

the driving module comprises a driving motor, an output end of which is connected to the sponge roller;

the garbage collection module comprises a garbage box and a garbage box cover, wherein an accommodation port for allowing the garbage box to be inserted therein is formed on a side face of the body shell, the garbage box is provided behind the sponge roller and a shovel strip is provided below an opening of the garbage box directly facing the sponge roller, the garbage box cover is further mounted above the garbage box, a row of hairbrushes are further provided on the garbage box cover, the hairbrushes are fitted with the sponge roller and used for cleaning the sponge roller, and a disposable garbage box is further provided in the garbage box;

the control module comprises a PCB control board, wherein the PCB control board is mounted within the body shell and is connected to the driving module and the water tank module, and the PCB control board is used for controlling the turn-on or turn-off of the driving module and the water tank module; and the power supply module comprises a battery used for supplying power to the driving module and the control module.

2. The handheld sweeping and mopping structure according to claim 1, wherein the water supply means comprises a water-pump inlet pipe, a water pump and a clean water outlet pipe, wherein the water-pump inlet pipe is communicated with the clean water tank, the water pump is disposed between the clean water outlet pipe and the water-pump inlet pipe, and the clean water outlet pipe is provided at one end of the cleaning sink; and the water pumping means includes an air-pump inlet pipe, an air pump, an air-pump outlet pipe and a waste water inlet pipe, wherein the air-pump inlet pipe is communicated with the waste water tank, the air pump is disposed between the air-pump inlet pipe and the air-pump outlet pipe, the waste water tank is further connected to the waste water inlet pipe, and the waste water inlet pipe is provided at the other end of the cleaning sink away from the clean water outlet pipe.

3. The handheld sweeping and mopping structure according to claim 2, wherein a waste water inlet is formed at a junction of the waste water inlet pipe with the waste water tank, and an anti-backflow means is further provided within the waste water tank; the anti-backflow means comprises a support and a water blocking sheet; the water blocking sheet is a bendable light-weight elastic sheet; the support is used for fixing the water blocking sheet at the waste water inlet; and, a clearance is reserved between the water blocking sheet and the waste water inlet, so that water in the waste water inlet pipe can enter the waste water tank after the water pumping means is activated, and the water blocking sheet can cover the waste water inlet after the water pumping means is deactivated.

4. The handheld sweeping and mopping structure according to claim 1, wherein the disposable garbage box is made from waterproof paper.

5. The handheld sweeping and mopping structure according to claim 1, wherein the body shell comprises an upper cover and a lower cover; an upper turnover cover capable of being opened or closed is provided on a surface of the upper cover; the upper turnover cover is located directly above the cleaning sink; a lower turnover cover capable of being opened or closed is further provided on the lower cover of the body shell; and, the lower turnover cover is located directly below the sponge roller, and the sponge roller can be taken out from the lower turnover cover after the lower turnover cover is opened.

6. The handheld sweeping and mopping structure according to claim 1, wherein a front baffle is further provided outside the body shell and is connected to the body shell through a number of buffer springs.

7. The handheld sweeping and mopping structure according to claim 1, wherein a control switch connected to the PCB control board is provided on the handle.

8. The handheld sweeping and mopping structure according to claim 1, wherein auxiliary roller wheels capable of rotating relative to the body shell are provided around a lower surface of the body shell.

* * * * *